United States Patent [19]

Ikegami et al.

[11] 4,150,801

[45] Apr. 24, 1979

[54] AUTOMATIC WINDING MACHINE FOR WIRE-LIKE OBJECT

[75] Inventors: Yoshio Ikegami, Miki; Yoshihumi Mukai; Hidehumi Satoh, both of Kobe; Koichi Kondo, Akashi, all of Japan

[73] Assignee: Kobe Steel, Ltd., Kobe, Japan

[21] Appl. No.: 908,778

[22] Filed: May 23, 1978

Related U.S. Application Data

[63] Continuation-in-part of Ser. No. 737,539, Nov. 11, 1976, abandoned.

[30] Foreign Application Priority Data

| | | | |
|---|---|---|---|
| Oct. 30, 1975 | [JP] | Japan | 50-131973 |
| Oct. 30, 1975 | [JP] | Japan | 50-149229 |
| Oct. 30, 1975 | [JP] | Japan | 50-149230 |
| Jan. 21, 1976 | [JP] | Japan | 51-6193 |

[51] Int. Cl.[2] ..... B65H 54/28

[52] U.S. Cl. ..... 242/158 R; 242/158.2; 242/158.4 R

[58] Field of Search ..... 242/158 R, 158.4 R, 242/158.2, 25 R, 7.15, 7.16

[56] References Cited

U.S. PATENT DOCUMENTS

| | | | |
|---|---|---|---|
| 3,031,153 | 4/1962 | Attwood et al. | 242/158 R |
| 3,039,707 | 6/1962 | Beck et al. | 242/7.16 |
| 3,128,956 | 4/1964 | Schumann | 242/158.4 X |
| 3,319,070 | 5/1967 | Schneider | 242/158 R X |
| 3,833,184 | 9/1974 | Hara et al. | 242/158 R |
| 3,951,355 | 4/1976 | Morioka et al. | 242/158 R |
| 3,997,128 | 12/1976 | Hara et al. | 242/158.4 R |

*Primary Examiner*—Stanley N. Gilreath
*Attorney, Agent, or Firm*—Oblon, Fisher, Spivak, McClelland & Maier

[57] ABSTRACT

An automatic winding machine for winding a wire-like object such as an electric wire on a drum portion of a bobbin in multiple closely packed layers. The automatic winding machine includes a position detecting member for automatically detecting the position of a wire-like object which is about to be wound around the drum portion of a bobbin, and a traverser member for the wire-like object while both the position detecting member and traverser member may operate in synchronism with each other, with the result that the winding of the wire-like object around a drum portion of a bobbin may be achieved extremely accurately over the entire width of the drum portion, with freedom from the danger of lap or irregular winding. In addition, the position detecting member is provided with hold-down contacting elements which are adapted to hold down the wire-like object upon completion of the traversing of the traverser member in one direction according to the accurate detection of detecting members, thus ensuring automatic traversing movement of the traverser member with the accompanying freedom from danger of contacting elements being disengaged from the wire-like object inadvertently. In addition, the position detecting member is lifted a distance from the wire-like object, which distance is equal to the diameter of the wire-like object, due to the detecting members, such as limit switches or the like, when the position detecting members approach a flange of the bobbin. As a result, the winding of the wire-like object for the next upper layer may be accomplished smoothly.

10 Claims, 29 Drawing Figures

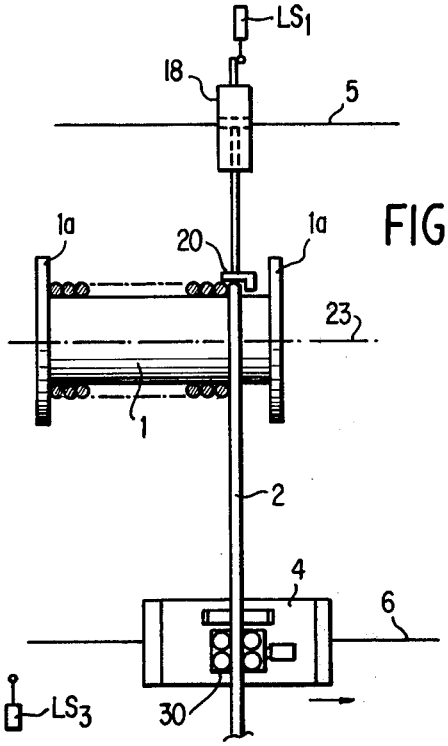
FIG.7
FIG.8A
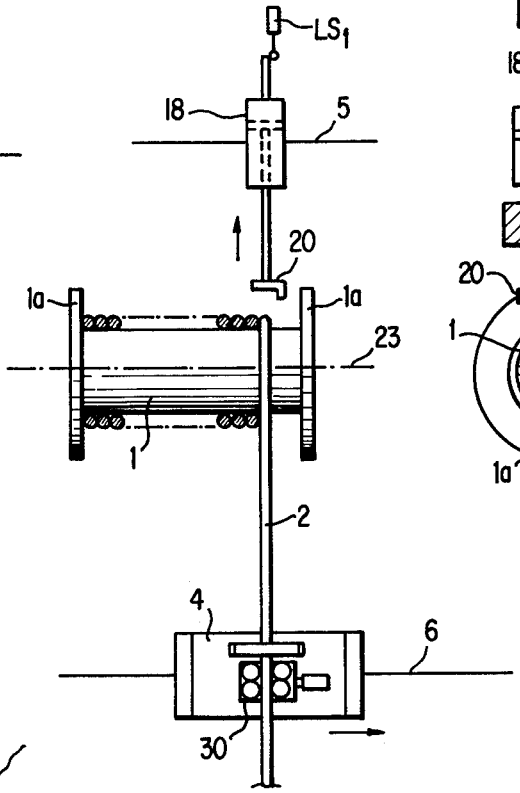
FIG.8B
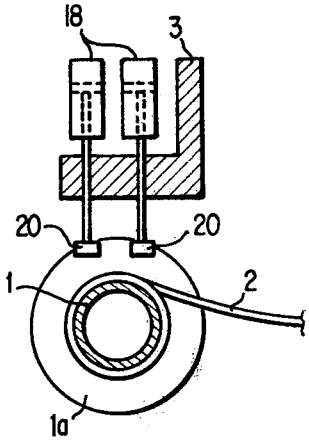
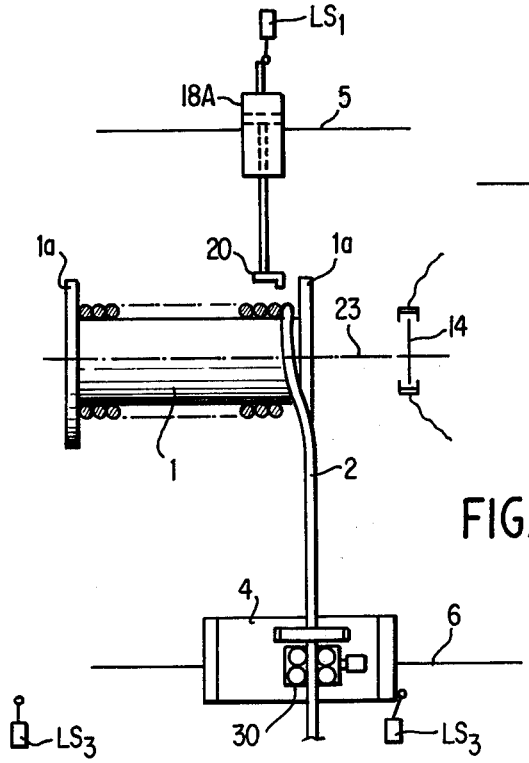
FIG.9

AUTOMATIC WINDING MACHINE FOR WIRE-LIKE OBJECT

BACKGROUND OF THE INVENTION

Field of the Invention

This invention relates to an automatic winding machine for automatically winding a wire-like object, such as an electric wire, on a bobbin and is a Continuation-in-Part Application of Ser. No. 737,539, filed Nov. 11, 1976, now abandoned.

Description of the Prior Art

A wire winding machine is known, in which a continuous wire-like object such as an electric wire is wound in multiple layers around a drum portion of a bobbin having flanges. The prior art wire winding machines however suffer from a shortcoming in that there is provided only a phase difference O between the center of a wire-like object which is about to be wound on a bobbin and the position of a traverser means serving as a guide means for the wire-like object, with the result that, upon reversing a traversing stroke of a traverser body, there may not be achieved accurate control for the aforesaid reversing operation of the traverser means, thus presenting a possibility of a lap wind-up layer.

Japanese Laid-open Patent Application No. SH049-112182 teaches a wire-like winding machine, in which a traverser body is integral with a guide member, and there is provided a cylinder extending in parallel with the axis of a bobbin and adapted to urge a wire-like object through the medium of a guide member in the direction parallel with the axis of a bobbin but against the direction of the wire-like object which is being wound. This winding machine however possesses a problem that, when the guide member approaches to one flange end of a bobbin, the guide member is so designed as to turn through an angle of 180°, while the traverser body does not move to the direction of a wire-like object being wound but remains still in its turning position, with the result that when a wire-like object is wound up to a flange end of the bobbin, the wire-like object is wound on the bobbin at an angle to the line normal to the axis of the bobbin, thereby failing to achieve desired closely packed layers of the wire-like object, in case the object has an irregular cross sectional configuration, such as that of a self-supporting cable, In addition, the guide member applies no force to the wire-like material at its winding position on a peripheral surface of a drum portion of the bobbin. This is considered to be responsible for the aforesaid failure in achieving closely packed layers of the wire-like object over the entire width of the drum portion of the bobbin.

SUMMARY OF THE INVENTION

It is the first object of the present invention to provide an automatic winding machine for a wire-like object such as an electric wire, which may avoid the aforesaid shortcomings confronted by the prior art winding machines, and which enables automatic, accurate winding of a wire-like material on a drum portion of a bobbin in closely packed layers.

It is the second object of the present invention to provide an automatic winding machine for a wire-like object which may completely prevent lap-winding or loose winding of a wire-like object around the drum portion of a bobbin.

It is the third object of the present invention to provide an automatic winding machine for a wire-like object, which may be used for a wire-like object having an irregular cross sectional configuration, such as that of a self-supporting cable.

According to the first aspect of the present invention, there is provided an automatic winding machine for a wire like object, which includes: a wire-like-object-position detecting member provided with a first synchronizing mechanism for moving in synchronism with a traverser member, and holddown contacting element or elements which are positioned above a drum portion of a bobbin and reciprocate in parallel with the axis of the bobbon on a first traverse shaft extending in parallel with the axis of the bobbin, the aforesaid contacting elements being so designed as to hold down the wire-like object against the surface of the drum portion of the bobbin in the position of the wire-like object which is about to be wound on the drum portion of the bobbin; traverser means reciprocating, being driven by a second traverse shaft extending in parallel with the axis of the bobbin, and provided with a second synchronizing mechanism for moving in synchronism with the aforesaid position detecting means; and lifting means for ascending and descending the aforesaid position detecting means and traverser means in the vertical direction, which is perpendicular to the axis of the bobbin.

According to the second aspect of the present invention, there is provided an automatic winding machine equipped with a r.p.m. detecting means for detecting the r.p.m. of a bobbin.

According to the third aspect of the present invention, there is provided an automatic winding machine of the type described, wherein a hold-down contacting element is pivoted to a lifting member adapted to ascend and descend contacting element, and the hold-down contacting element has an end which is of a 'L' shape or 'T' shape suited for its contacting engagement with a wire-like object.

According to the fourth aspect of the present invention, there is provided an automatic winding machine as set forth in the first aspect of the invention, wherein a pair of hold-down contacting elements are adapted to reciprocate, commensurate with the reciprocating movements of a position detecting member detecting the position of a wire-like object.

According to the fifth aspect of the present invention, there is provided an automatic winding machine as set forth in the first aspect of the invention, wherein there are provided detecting members including limit switches or photo-switches for detecting the arrival of a hold-down contacting element to the flange end of a bobbin.

According to the sixth aspect of the present invention, there is provided an automatic winding machine as set forth in the first aspect of the invention, wherein a pair of flange-to-flange distance detecting members are provided in a manner to contact and to be detached from the inner surfaces of the opposite flanges of a bobbin.

According to the seventh aspect of the present invention, there is provided an automatic winding machine as set forth in the first aspect of the invention, wherein there is provided a resistance producing mechanism, such as a torque motor, for use with the aforesaid position detecting means.

BRIEF DESCRIPTION OF THE DRAWINGS

Various other objects, features, and attendant advantages of the present invention will be more fully appreciated as the same becomes better understood from the following detailed description when considered in connection with the accompanying drawings, in which the reference characters designate like or corresponding parts throughout the several views, and wherein:

FIGS. 4*a* to 12 are views illustrative of the sequence of a winding operation of a winding machine according to the invention;

DESCRIPTION OF THE PREFERRED EMBODIMENTS

Figure 1:
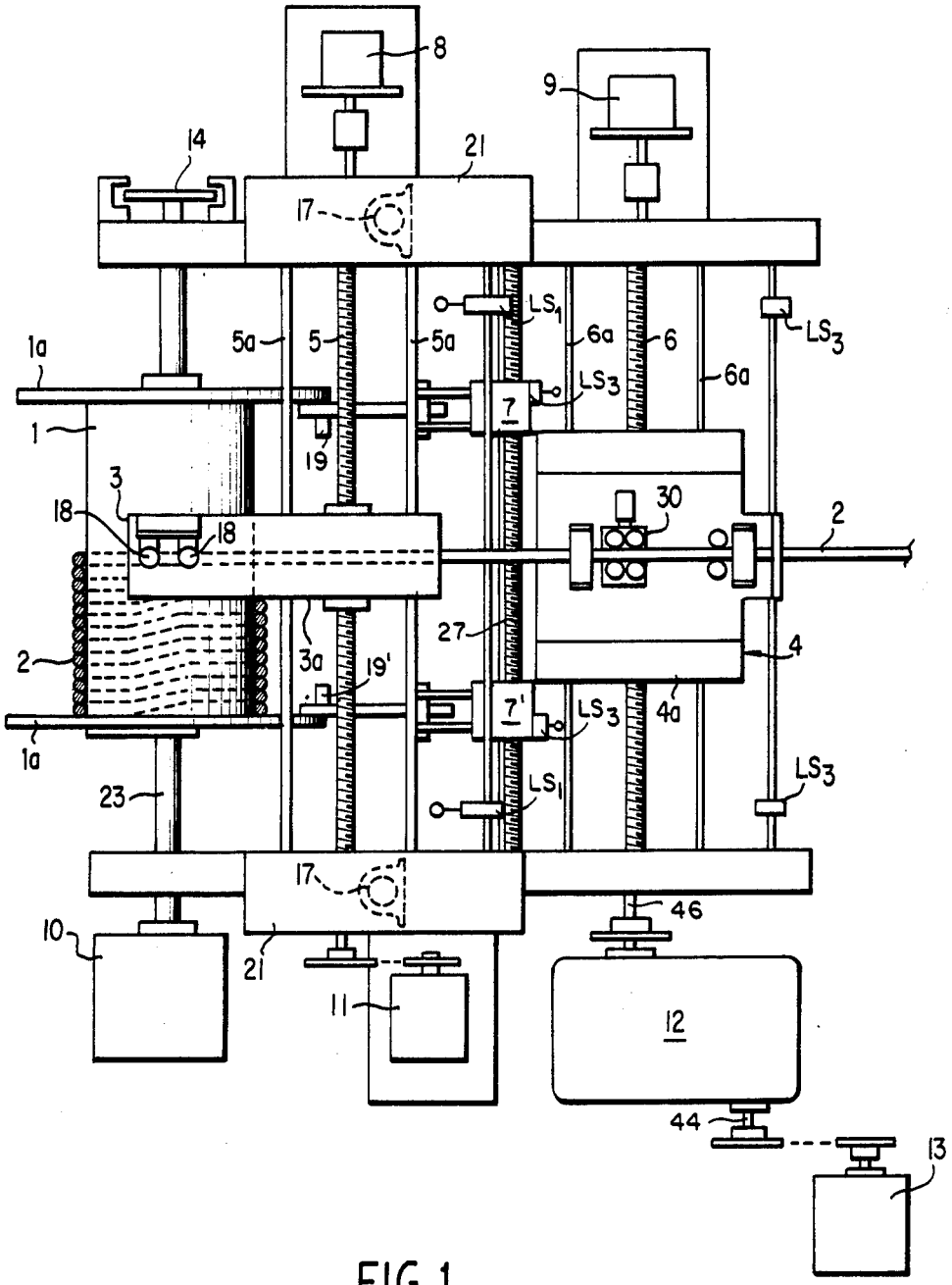
FIG. 1 is a plan view of the first embodiment of the winding machine according to the present invention.
Figure 2:
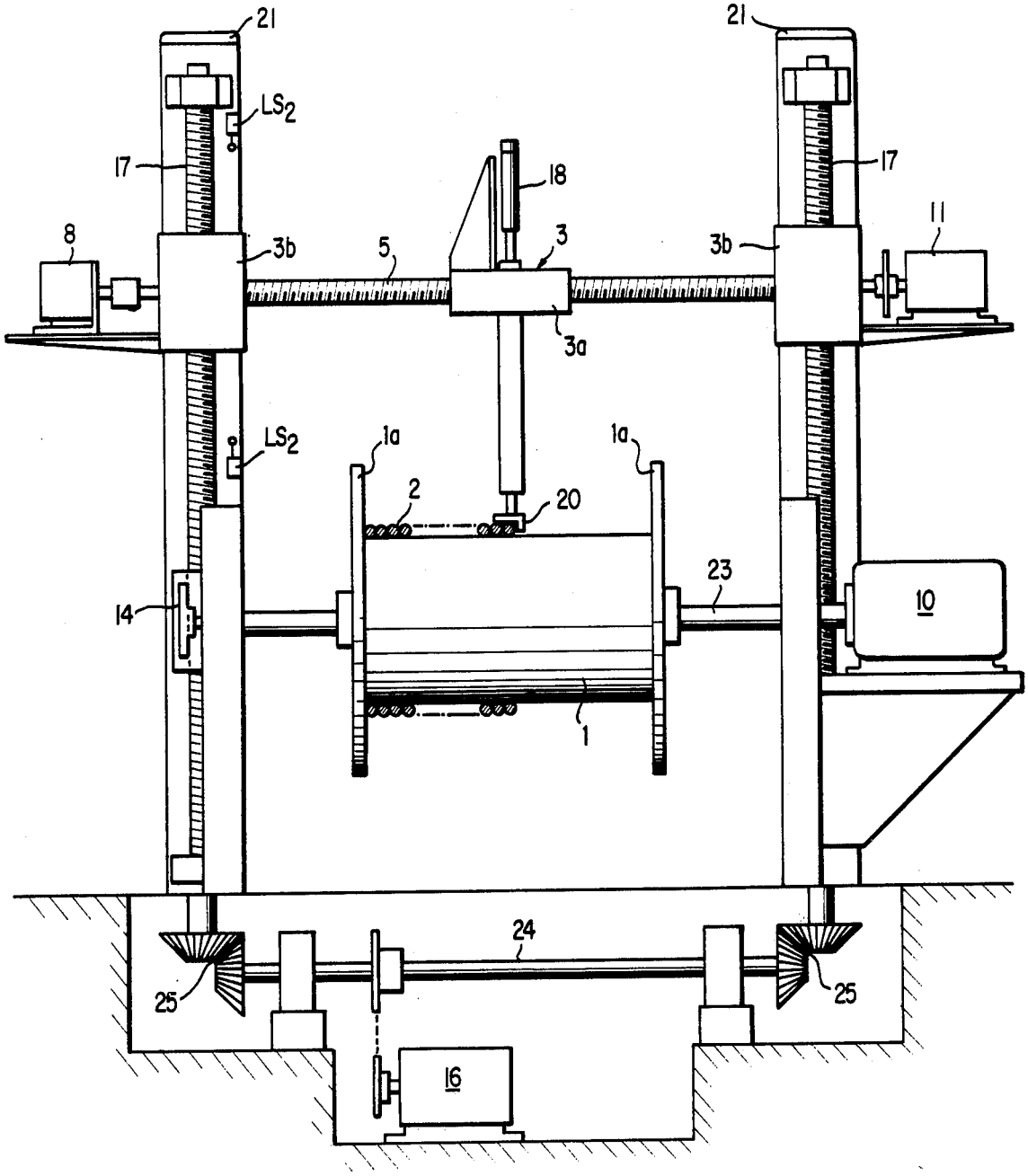
FIG. 2 is a front view of an essential part of a position detecting means.

These and other objects and features of the present invention will be apparent from a reading of the ensuing part of the specification which indicate embodiments of the invention. A bobbin 1 is formed with flanges 1*a* at the opposite ends thereof. The bobbin 1 is removably fitted on a bobbin shaft 23 which is supported in a frame in a rotatable manner by means of a bobbin drive motor 10. A r.p.m. detecting means 14 is provided at one end of the bobbin shaft 23. R.P.M. detector 14 generates a plurality of pulses every rotation of the bobbin so that rotation angle of the bobbin can be detected by the number of generated pulses. A wire-like object 2, such as an electric wire, is to be wound around the peripheral surface of a drum portion of the bobbin in multiple, closely packed layers. A winding position detecting means 3, is provided for detecting the position of the wire-like object 2 which is about to be wound around the peripheral surface of a drum portion of the bobbin 1. The winding position detecting means 3 is provided with a lifting means 18 such as an air cylinder, so as to move up and down relative to the peripheral surface of the drum portion. A body 3*a* of position detecting means 3 has a pair of hold down contacting elements 20 in depending relation thereto and is threadedly fitted on a threaded first traverse shaft 5. (This shaft 5 has a considerably large pitch and is a kind of an idle shaft, although this is not completely an idle shaft for the reason to be described later.) Shaft 5 is supported on a pair of left-hand, right-hand supporting frames 3*b*, 3*b*. Extending between the supporting frames 3*b*, 3*b* and the body 3*a* are linearly-guiding guide shafts 5*a* which extend in parallel with the threaded shaft 5. As a result, the body 3*a* may reciprocate along the drum portion of the bobbin 1, as the wire-like object is being wound around the peripheral surface of the drum portion. The threaded shaft 5 is provided with a torque motor 11 serving as a force or resistance-producing means. A potentiometer 8 is provided as a synchronizing mechanism for the traverser means 4 to be described hereinafter. As best shown in FIG. 2, a pair of supporting frames 3*b*, 3*b* are threadedly fitted on threaded shafts 17, 17 for lifting member 21, 21 by means of threaded holes provided in the frames 3*b*, 3*b*, while the threaded shafts 17, 17 are provided through the medium of bevel gears 25, 25 by means of drive shaft 24 which is driven by a motor 16. The rotation of the threaded shafts 17, 17 causes the supporting frames 3*b*, 3*b* to ascend. When the hold-down contacting element comes close to one of the flanges 1*a*, 1*a* of the bobbin 1, the contacting element 20 is lifted a distance corresponding to the diameter of a wire-like object for the next upper layer. As shown in FIG. 1, there is provided limit switches $LS_1$, $LS_1$ for detecting that the position detecting means 3 approaches to the bobbin flange 1*a*. Also as shown in FIG. 2, limit switches $LS_2$, $LS_2$ for detecting the upper and lower limit positions of the body 3*a* are provided within one of the frames of the lifting member 21.

The position detecting means 3 is moved by means of the wire-like object 2 which is being wound around a drum portion of a bobbin, and the threaded shaft is rotated by the horizontal movement of the position detecting means 3. It is desired for the winding of the wire-like object that hunting be prevented and the wire-like object is wound in a closely packed layer, for which a resistance or force should be imparted to the wire-like object in the direction against the direction of the wire-like object which is being wound. The torque motor 11 is, for this purpose, connected with and applies torque to the threaded shaft 5 whereby resistance or force is imparted to the wire-like object through the position detecting means 3.

Figure 3:
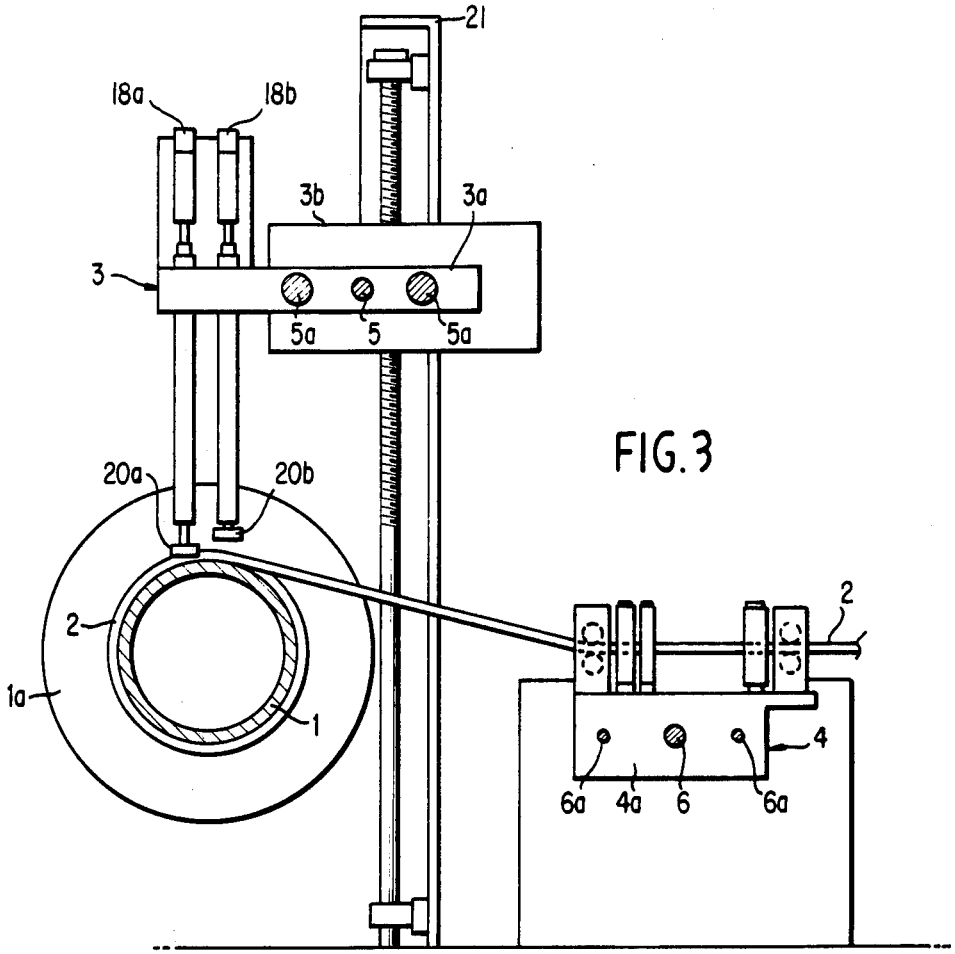
FIG. 3 is a side view of position detecting means, and a traverser means, and a longitudinal cross-sectional view of the essential part thereof.

As best shown in FIGS. 1 and 3, a body proper 4*a* of the traverser member 4 is threadedly fitted on a threaded shaft 6 supported on the frames of a winding machine by means of threaded holes provided in the body proper 4*a*, and loosely fitted on linearly-guiding guide shafts 6*a*, 6*a* supported by the supporting frames 3*b*, 3*b*. This shaft 6 is a drive shaft. As a result, the body proper 4*a* may reciprocate, being driven by the threaded shaft 6 being rotated in the normal and reverse directions through the medium of a stepless speed change gear 12 by a traversing motor 13. A potentiometer 9 is provided at the other end of the threaded shaft 6 as a synchronizing member for maintaining the shaft 6 in synchronism with the position detecting means 3.

The reason why the torque motor 11 is used as a drive motor for the threaded shaft 5 for the position detecting means 3 is that, upon the traversing of the means 3, with the wire-like object 2 being wound, hunting due to deflection of the wire-like object 2 may be prevented, and a resistance or force is imparted to the wire-like object 2 in the direction against that of the object 2 which is being wound, so as to bring a winding of wire-like object into close contact with the preceding winding of the wire-like object. In addition, the reason why potentiometers 8, 9 are provided at each end of the threaded shafts 5, 6 for bringing the position detecting means 3 in synchronism with the traverser means 4 is that the position detecting means 3 traverses in response to the movement of the wire-like object, as the wire-like object is being wound on the bobbin 1, so that the threaded shaft 5 is rotated due to the movement of the position detecting means 3 by use of a Tsubaki ball screw mechanism as utilized by the Tsubakimoto Precision Products Co., Ltd., and thus the position of the wire-like object being wound on the bobbin 1 may be detected, because the threaded shaft 5 is coupled to the potentiometer 8. On the other hand, the traverser means 4 moves along the threaded shaft 6, being driven thereby, and then the potentiometer 9 is actuated. Thus both potentiometers 8, 9 detect the positions of the means 3 and 4, respectively. When there results a difference therebetween, then the movement of the traverser means 4 is compensated for by means of a stepless speed change gear, thereby bringing the movements of both means 3 and 4 into synchronism with each other.

Figure 16:
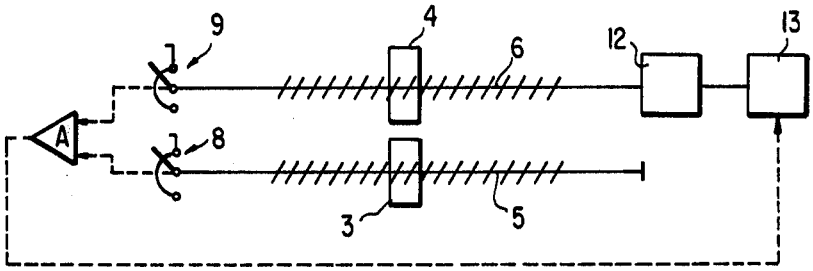
FIG. 16 is a circuit diagram of a synchronizing mechanism.

Potentiometers 8 and 9, which are provided at each end of the threaded shafts 5 and 6, respectively, are shown in the schematic circuitry diagram of FIG. 16. Potentiometers 8 and 9 include an appropriate resistance therein so that the positions of the porition detecting means 3 and the traverser means 4 can be detected by the resistance value of the potentiometers 8 and 9. The resistances of the potentiometers 8 and 9 are so adjusted that each potentiometer indicates the same resistance value when the position detecting means 3 exists at the corresponding position of the traverser means 4.

In the operation of this mechanism, the position detecting means 3 traverses in response to the movement of the wire-like object whereby the resistance value of the potentiometer 8 varies. On the other hand, the resistance value also varies in response to the movement of the traverser means 4 and the rotation of the threaded shafts. The resistance values of the potentiometers 8 and 9 are converted to the voltage values and the voltage values are compared with each other in comparison means A. According to the difference in the voltage of the potentiometers 8 and 9, the motor 13 is controlled appropriately whereby the traverser means 4 is adjusted to be at the corresponding position of the position detecting means 3. Pulse pick up can be used to detect the position of the position detecting means and traverser means in place of potentiometer.

Motor 13 rotates at a constant speed and is connected with a threaded shaft 6 through PIV 12. Motor 13 serves to rotate the threaded shaft 6 and reverse the rotation of the threaded shaft 6 on receiving a signal being emitted from $LS_3$.

The PIV 12 is a stepless speed change gear and serves to change the rotation speed of the threaded shaft 6 on receiving a signal being emitted from comparator A whereby a difference between positions of position-detecting means 3 and traverser means 4 is compensated for through the medium of the PIV 12.

Figure 18A:
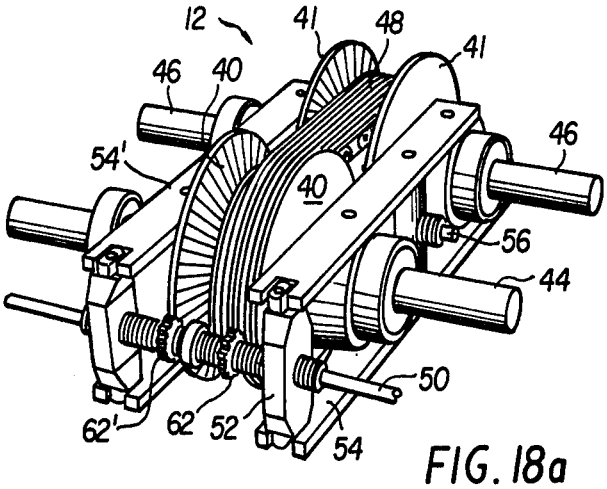
FIGS. 18*a–e* shows a variable speed gear mechanism.
Figure 18B:
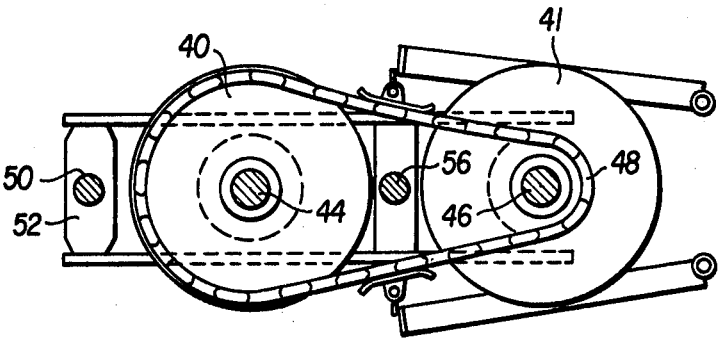

The PIV 12 and its function is illustrated in FIGS. 18*a–e* and includes a pair of bevel gears 40, 41 facing one another, are fixed to each of two main shafts 44, 46, and engage with both sides of chain 48. In other words, each pair of the conical bevel gears is positioned to the left and right of the chain with the gear tops of the one side facing the shallow grooves of the other. The bevel gears can be moved in an axial direction, and chain-engaging pitch diameter is changed by adjusting distance between two gears. FIGS. 18*a, b* show the gear and chain setting at maximum speed and distance between a pair of bevel gears on the input shaft 44 is small and the chain is pushed toward the gear periphery to transmit power in a large diameter pitch cycle, On the other hand, distance between a pair of bevel gears 41 on the output shaft is large and the chain 48 engages with the gears at the position nearest to the center to transmit power in a small diameter pitch cycle.

Figure 18C:
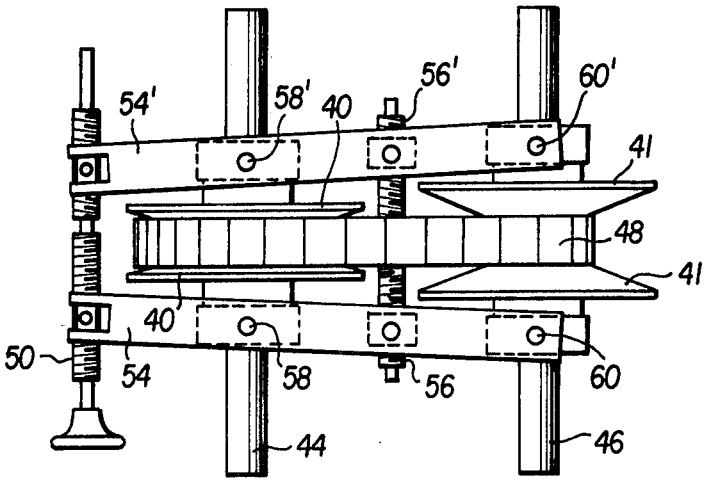
Figure 18D:
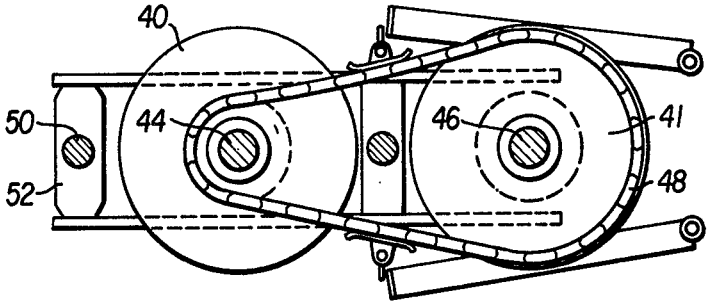

FIGS. 18*d, e* show the gear and chain setting at lowest speed, i.e. reverse of maximum speed condition: bevel gears 40 on the input shaft 44 engage with the chain at the position nearest to the center, and bevel gears 41 on the output shaft 46 engage with the chain 48 at the periphery.

Figure 18E:
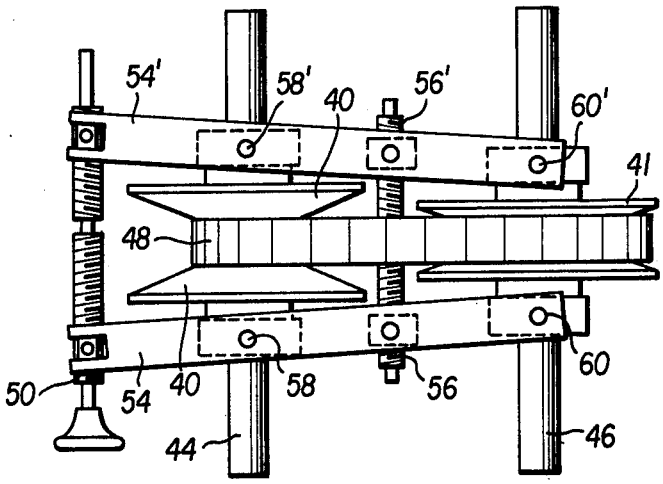

The control mechanism for PIV 12 includes a control screw 50 disposed within and interconnecting first and second control units 52 mounted between upper and lower operation plates 54, 54'. The upper and lower operation plates 54, 54' are each pivotable about and interconnected by an intermediate control shafts 56, 56' as well as first pivot members 58, 58' and second pivot members 60, 60' which serve to axially adjust the setting of the pair of bevel gears 40, 41 as described hereinabove in response to the adjustment of speed-ratio adjusting nuts 62, 62' mounted on control screw 50 and as shown in FIGS. 18*c*, 18*e*.

The reason why the hold-down contacting element 20 is so designed as to ascend and descend by means of the lifting means 18, such as an air cylinder, is that the wire-like object 2 may positively engage the surface of a drum portion of a bobbin under a given pressure. The contacting element 20 is of a 'L' shape, as shown in FIG. 2, so as to press the wire-like object from above and aside. Alternatively, however, the shape of an end of the contacting element 20 may be of a 'T' shape. In either case, the height of such a wall of the element 20 which engages the side of the wire-like object material 2 should be slightly smaller in dimension than the diameter of a wire-like object, so as to prevent a bottom end of the element 2 from contacting the wire-like object in the under-lying layer. In the case of the 'T' shaped contacting element, it is preferable that a horizontal portion 15 of the 'T' shaped element may be retracted, when the contacting element 20 approaches to a flange of a bobbin. For lowering the contacting element 20 onto the wire-like object 2 for holding same down, the element 20 is first lowered some distance above a wire-like object by means of the threaded shaft 17 in the lifting means 21, and then the lowering of the element 20 for eventual contact with the wire-like object 2 is carried out by means of the lifting means 18. Under the above condition, the position detecting means 3 (member 3*a*) traverses on the threaded shaft 5, as the winding of a wire-like object proceeds. In this respect, it should be noted that the position detecting means 3 is moved by means of the wire-like object 2 which is being wound around a drum portion of a bobbin. For this reason, the prevention of hunting, and for the winding of the wire-like object 2 in a closely packed layer, it is mandatory that a resistance or force be imparted to a wire-like object in the direction against the direction of the wire-like object which is being wound, by means of the torque motor 11. Shown at $LS_3$, $LS_3$ in FIG. 1 are limit switches for detecting the opposite limits for a traversing stroke of the traverser means 4 and the positions of the means 4 to be turned around or to reverse the course.

As shown in FIG. 3, as an alternative, a hold-down contacting element 20*a* providing for the rightward winding of the wire-like object 2 and a lifting means 18*a* such as an air cylinder for ascending and descending the contacting element 20*a* may be provided on one hand, while another holding down contacting element 20*b* providing for the leftward winding of a wire-like object 2, and a lifting member 18*b* for ascending and descending the contacting element 20*b* are provided on the other, thereby providing a pair of hold-down contacting elements whose operations are independent of each other for the leftward and rightward winding of the wire-like object 2. Still alternatively, as shown in FIG. 13, a single contacting element may be formed with a 'T' shaped end, or a contacting element having a 'L' shaped end may be so designed as to turn through an angle of 180°.

Figure 19:
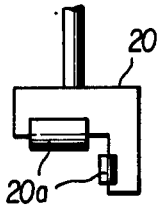
FIG. 19 shows roller members for the hold down contacting element of the present invention.

The 'L' shaped contacting element 20 contacts a wire-like object all the time so that rollers or bearings 20*a* should preferably be provided for the contacting element 20 so as to eliminate a frictional resistance on a contacting surface between the end of the element 2 and the wire-like object as shown in FIG. 19.

According to the winding machine of the invention, there is provided an increased-wind-up-diameter-detecting member provided, which detects the arrival of the contacting element 20 to the flange of a bobbin, thereby preventing the increased wind-up diameter portion of the wire-like object in the vicinity of the flange portion of the bobbin.

Figure 13:
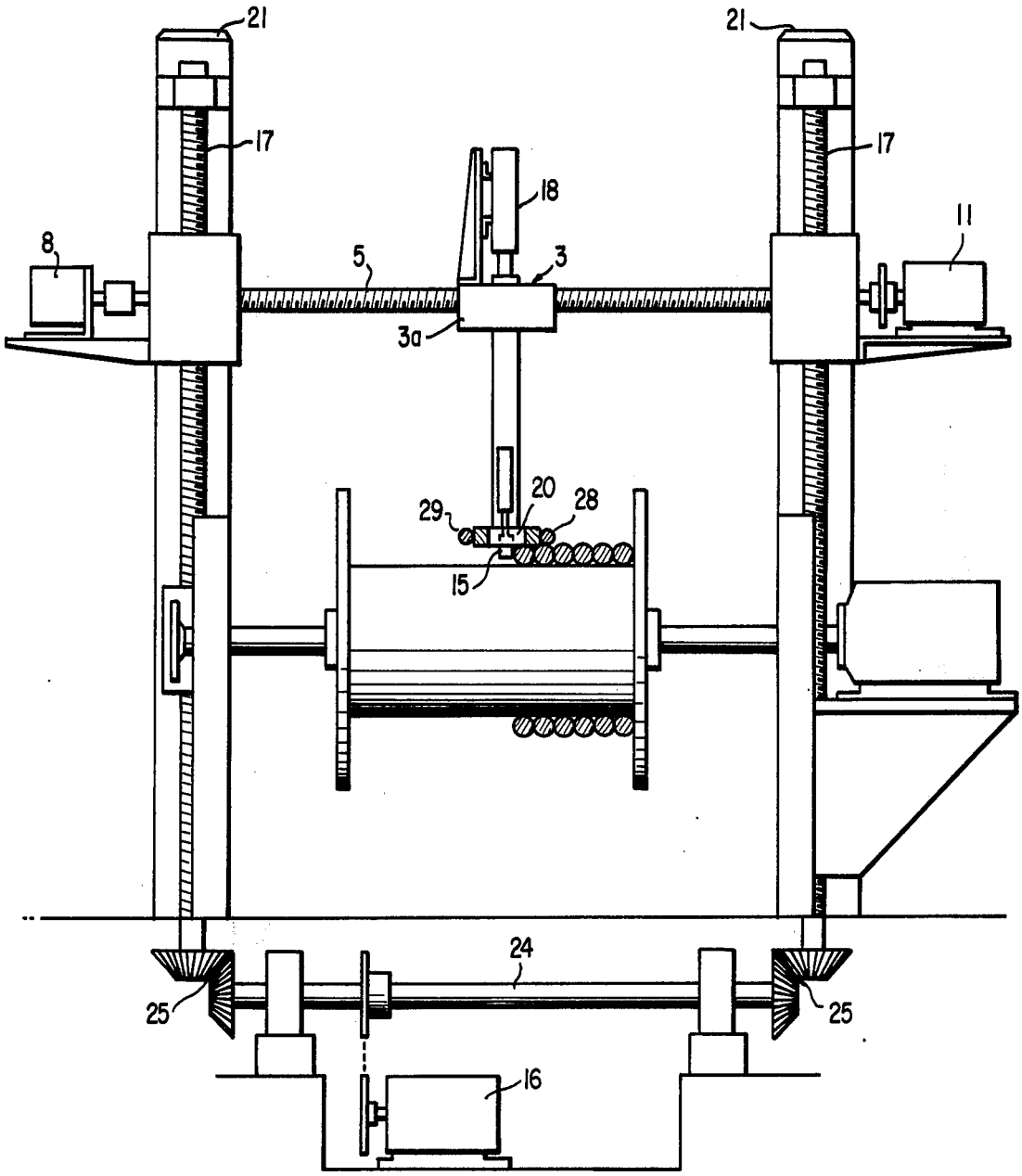
FIGS. 13, 14 are views illustrative of a contacting element and a member for detecting an increased wind-up diameter of a coil.
Figure 14:
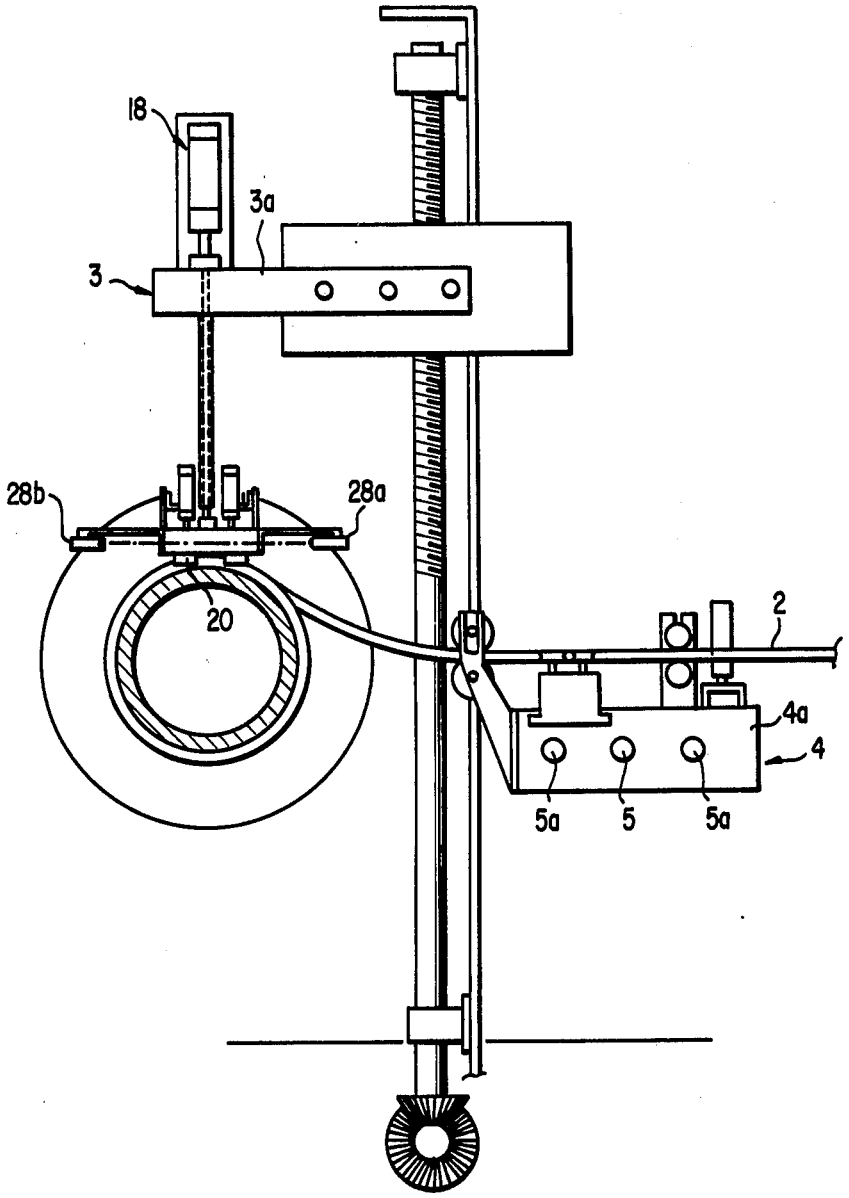

The aforesaid increased wind-up diameter detecting member may be provided in the form of a photo-switch such as a photoelectric tube as shown in FIGS. 13 and 14 in place of the aforesaid limit switch LS. However, in the case of the aforesaid photo-switch, as best shown in FIGS. 13 and 14, there is provided a photo-switch 28 and another photo-switch 29 at opposite ends of the hold-down contacting element 20 as viewed in the traversing direction of the position detecting means. The aforesaid photoswitch 28 has front and rear photoelectric-tube-light receiving portions 28*a*, 28*b*, and the aforesaid photo-switch 29 has front and rear photo-electric-tube-light emitting portions 29*a*, 29*b*, respectively, although the functions of the photo-switches are similar to those of the aforesaid limit switches.

These photo-switches are provided on the contacting element 20 to detect whether or not the wire-like object begins to be wound correctly on the drum portion. If the wire-like object is, for example, wound on the flange portion of the drum, the photoswitch, in response to interruption of light reception, operates a warning buzzer or light to inform the operator of incomplete winding of the wire-like object. For this reason, limit switches may be provided for the contacting element 20 instead of the photo switches. The photo-electric tube as shown in FIGS. 13 and 14 is provided at the end of the hold-down contacting element 20 in order to detect when the wire-like object begins to be wound in the next layer.

When the initiation of winding in the next layer is detected by the photoelectric tube 28, the r.p.m. detector 14 is actuated to detect the rotation angle of the bobbin 1 as shown in FIG. 16.

Figure 20A:
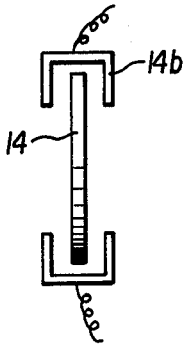
FIGS. 20*a, b* show the detector mechanism of the present invention.
Figure 20B:
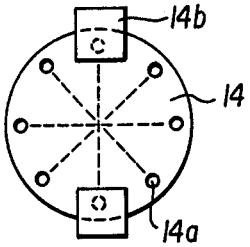

R.P.M. detector 14 comprises a disc having 8 holes 14*a* on the periphery thereof and an electromagnet 14*b* as shown in FIGS. 20*a*, *b*. The electromagnetic force changes when each hole 14*a* of the disc 14 passes through the electromagnet and the change of the electromagnetic force is counted by a conventional counter which is connected with the electro-magnet. If the change of the electromagnetic force is counted eight times, the same represents one turn of the disc 14.

When the traverser means 4 abuts $LS_3$, the R.P.M. detector 14 is actuated to detect the rotation angle of the bobbin 1 by counting the number of changes of the electromagnetic force. When counted seven times, a signal is emitted to the motor 11 attached to the position detecting means 3 whereby the direction of the contacting element 20 is changed from rightward to leftward. Then air cylinder 18 is operated to cause the hold down contacting element 20 to hold down the wire-like object in the next layer on receiving a signal emitted from the R.P.M. detector 14 when counted 15 times corresponding to $1\frac{7}{8}$ turns of the bobbin 1.

In the above case, only one hold down contacting element 20 is provided with respect to the position detecting means 3. If a pair of hold down contacting elements 20*a*, 20*b* are provided, as shown in FIG. 3, to the position detecting means 3 for leftward and rightward windings of the wire-like object, $1\frac{7}{8}$ turns of the bobbin is only detected and the signal is emitted from the R.P.M. detector 14 to the air cylinder 18*b* thereby causing the hold down contacting element 20*b* for leftward winding to hold down the wire-like object being wound in the next layer.

After detecting that the bobbin 1 is rotated by 1 6/8–$1\frac{7}{8}$ turns, the signal is transmitted to slide guide member 30, and air cylinder 18. At first, the slide guide member 30 is operated to urge the wire-like object in the direction of the wire-like object being wound and subsequently the air cylinder 18 is operated to cause the hold down contacting element 20 to hold down the wire-like object in the next layer. Then, the winding position detecting means 3 traverses in response to the movement of the wire-like object and the traverser means 4 is operated by the synchronizing mechanism as mentioned above.

In this explanation, the photoelectric tube is used to detect when the wire-like object begins to be wound in the next layer, but limit switch can also be used in place of the photoelectric tube. Limit switches LS and $LS_3$ are provided to stop the movement of the position detecting means 3 and traverser means 4.

For determining the traversing strokes of the position detecting means and traverser means for achieving the winding of a wire-like object in closely packed layers over the entire width of a drum portion of a bobbin, it is mandatory that the traversing strokes be brought into coincidence with the width of the drum portion of the bobbin accurately. Meanwhile, it has been a common practice in determining the aforesaid traversing strokes that a wire-like object is wound around the drum portion of a bobbin by paying visual attention to the winding of a wire-like object so as to provide closely packed layers, because of the varying conditions of the bobbin installed, and manufacturing errors of the bobbin itself, although rough setting of the strokes of the position detecting means and the traverser means is made in the prior art winding machine.

To cope with this, the winding machine according to the present invention provides a pair of drum width detecting members which may contact or may be detached from the inner surfaces of the opposite flanges of the bobbin, for detecting an inner width of the bobbin (a distance from the inner surface of one flange to that of another) accurately, thereby enabling uniform winding of a wire-like object, irrespective of the bobbins used.

Figure 15:
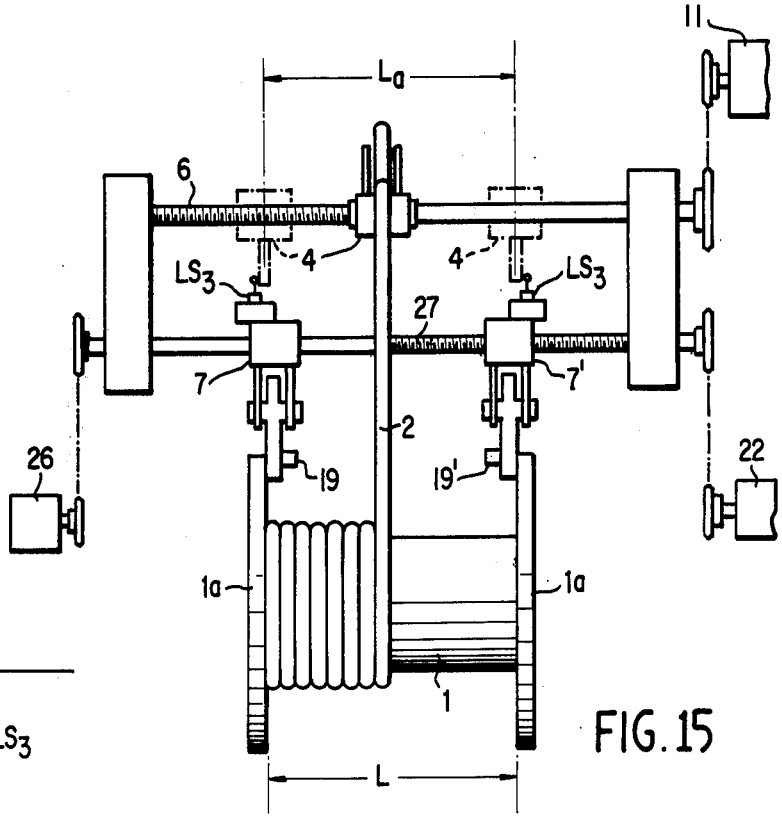
FIG. 15 is a view showing one embodiment of a flange-to-flange distance detecting member for a bobbin, as measured from the inner surface of one flange to that of another.

As shown in FIG. 15, there are provided a pair of detecting means 7, 7' which may be moved or stopped in the direction in parallel with the axis of the bobbin 1, on which a wire-like object is to be wound; contacting elements 19, 19' which are provided for the detecting members 7, 7', respectively, and which may contact the inner surfaces of flanges 1*a* of the bobbin 1 and may be kept away from the flanges 1*a* outwardly thereof; and limit switches LS for defining the traversing widths or the strokes of the traverser body 4*a* and a body proper 3*a* of the position detecting means 3, the aforesaid limit switches LS being positioned on the detecting members 7, 7', respectively.

The operational procedure of the detecting members 7, 7' is such that, before the commencement of winding of a wire-like object on a bobbin, the detecting members 7, 7' are first moved through the medium of the threaded shaft 27 by motors 22, 26 until the contacting elements 19, 19' contact the inner surfaces of the flanges 1*a*, after which the contacting elements are kept away from the flanges 1*a*. In this manner, limit switches $LS_3$ are accurately located in conformity with the width of the bobbin 1, thereby enabling the accurate determination of traversing strokes of the traverser means 4*a*.

The winding procedure of the wire-like object 2 around a drum portion of the bobbin 1 in multiple layers is carried out in the order shown in FIGS. 4A to 12.

Figure 4A:
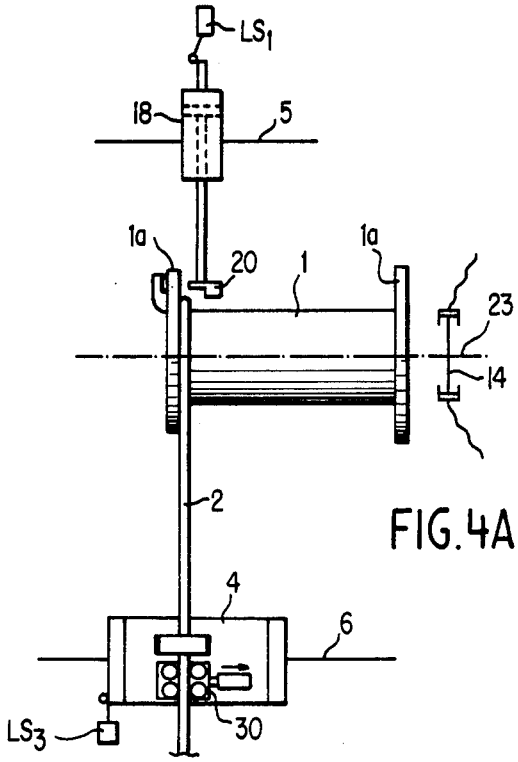
Figure 4B:
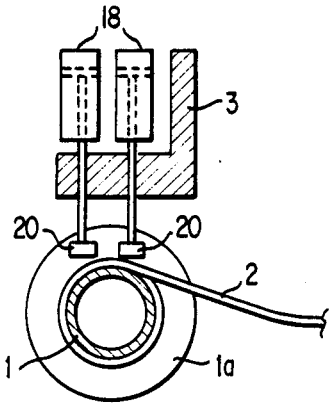

In other words, as shown in FIGS. 4A and 4B, the inner width of the bobbin is detected by means of the bobbin-width-detecting members in a manner described earlier; one end of the wire-like object 2 is secured to the flange 1*a* of the bobbin 1; and the bobbin 1 is rotated through $1\frac{7}{8}$ to 1 6/8 turns in which the wire-like object 2 is also urged by a slide guide member 30 in the direction of the wire-like object 2 being wound, while the r.p.m. of the bobbin is detected by the r.p.m. detecting means 14 provided at the end of the bobbin shaft 23.

Figure 5A:
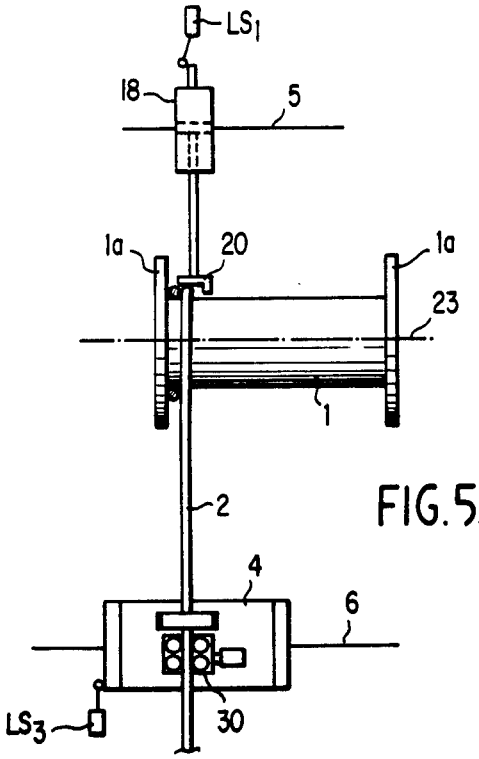
Figure 5B:
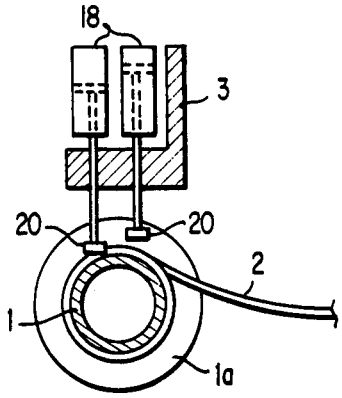

After the completion of the detection of r.p.m. of the bobbin 1, the position detecting means 3 is lowered due to the rotation of the threaded shaft 17 in the lifting means 21, so that the wire-like object 2 may be pressed by the contacting element 20 thereunder. In this respect, the position detecting means 3 is first lowered a distance above the wire-like object 2, and then one member 18*a* of a pair of the lifting members 18*a*, 18*b* is fed with pressurized air so as to allow the contacting element 20 to press the wire-like object under a given pressure. When a starting end of the wire-like object 2 is wound around a drum portion of the bobbin, the traverser means 4 positioned in the rear thereof begins traversing to the right as viewed in the drawing, due to the rotation of the threaded shaft 6. (This condition is shown in FIG. 5).

Figure 6A:
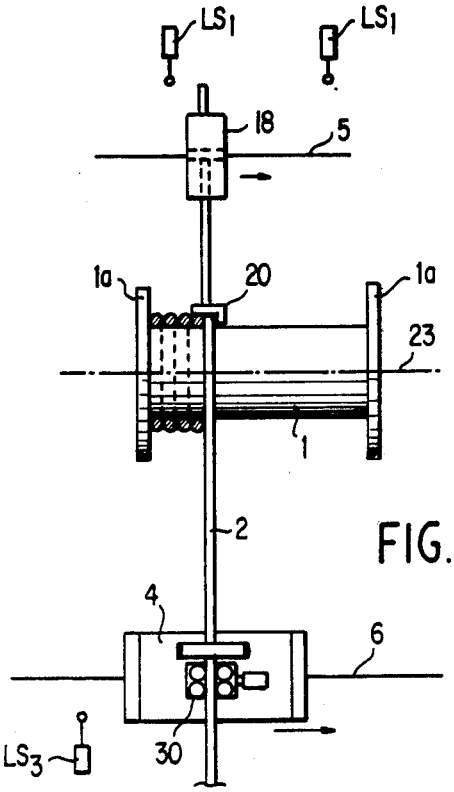
Figure 6B:
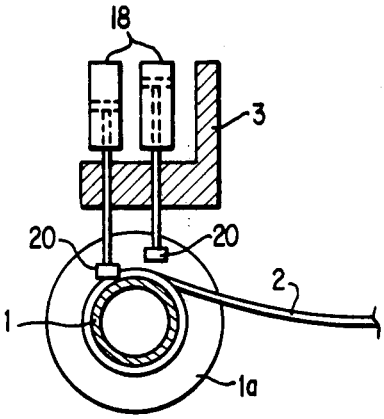
Figure 10:
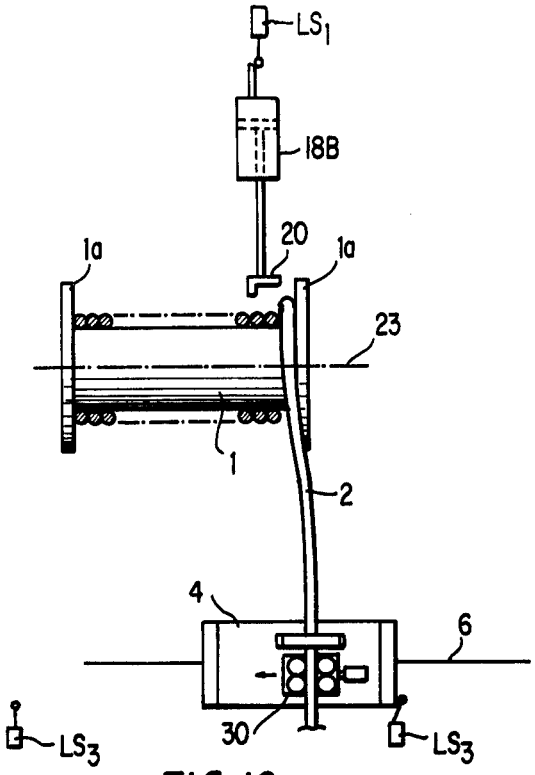
Figure 17:
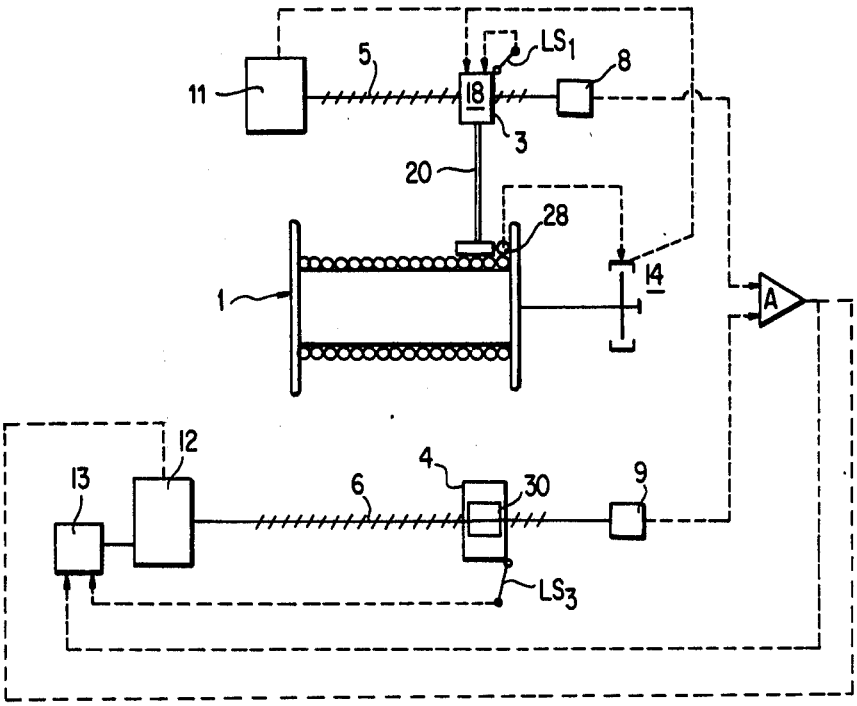
FIG. 17 is a circuit diagram of the relationship of the r.p.m. detector and the photoelectric tube.

As shown in FIGS. 6A and 6B, as the traverser means traverses, the bobbin 1 is rotated, and the wire-like object 2 is wound around the peripheral surface of a drum portion of the bobbin. As the winding of the wire-like object 2 proceeds, the position detecting means 3 moves along the threaded shaft 5 in the same direction as that of the traverser means 4 by the medium of the holddown contacting element 20 which engages the wire like object 2. Stated differently, the means 3 traverses by being urged by the wire-like object 2 being wound. As a result, there is no possibility of hunting due to deflection or waving motion of the wire-like object 2. In addition, a resistance or force in the direction against the traversing direction is imparted to the wire-like object 2 so as to enable the winding of the wire-like object 2 in closely packed layers. The positions of the means 3, 4 are detected and stored by the potentiometers 8, 9, during their movement. Thus, if there is a difference therebetween, the movement of the traverser means 4 may be compensated for though the medium of the PIV 12 via comparator A as shown in FIGS. 16 and 17 thereby bringing both means 3 and 4 in synchronism with each other.

In this manner, winding of the first layer of a wire-like object is carried out from the left to the right as viewed in the drawing. When the position detecting means 3 approaches to the inner surface of the right-hand flange 1*a* of the bobbin 1, then preparatory operations as shown in FIGS. 7 and 8 will be on their way.

Firstly, the position detecting means 3 abuts the detecting member $LS_1$, i.e., a limit switch on the side of the flange 1*a*, to which the position detecting means 3 makes approach, thereby detecting the wire-like object making approach to the flange 1*a*, whereby the threaded shafts 17, 17 are rotated so as to lift the means 3 by the medium of the supporting frames 3*b*, 3*b* a distance or height corresponding to a diameter (one pitch) of the wire-like object 2 to be wound in the second layer, with the result that the hold-down contacting element 20 is lifted from the wire-like object 2 from the position shown in FIG. 7 to the position of FIG. 8 by means of the lifting member 18*a*. The detecting member $LS_1$ is positioned a distance before the inner surface of the flange 1*a* of the bobbin, which distance is equal to the diameter of a wire-like object wound in the first layer. When the wire-like object in the first layer eventually contacts the inner side of the flange 1*a* of the bobbin, then the traverser means 4 abuts the detecting member $LS_3$, i.e., a limit switch located in this position beforehand to stop its movement directed to the right, whereupon the bobbin 1 is rotated by $\beta$ to 6/8 turn, so that the RPM detecting means 14 detects the aforesaid RPM of the bobbin 1. The detecting member, such as limit switch $LS_3$ or a photoelectric tube, serves to prevent the wire-like object 2 from riding on the flange 1*a* of the bobbin 1.

Figure 11:
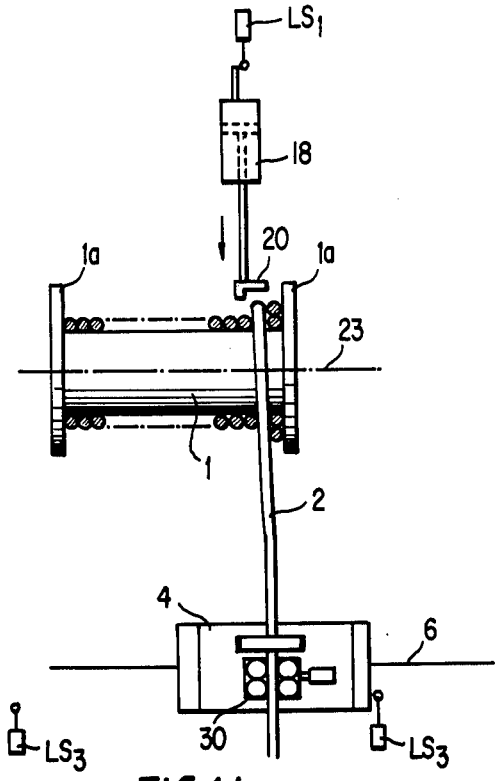

The winding of a wire-like object in the first layer is completed with the rotation of the bobbin rotating by $\frac{7}{8}$ to 6/8 turn. After the detection of the RPM of the bobbin 1, the bobbin 1 is rotated by $1\frac{7}{8}$ to 1 6/8 turns while the wire-like object 2 is also urged by the slide guide member 30 in the direction of the wire-like object 2 being wound so as to prevent the second wound object 2 from overlapping the first wound object 2 in the vicinity of the flange 1*a* as shown in FIG. 11, so that the first and second windings of the wire-like object 2 in the second layer is formed on the last winding of the wire-like object in the first layer. The RPM detecting means 14 detects the above RPM of the bobbin 1, after which another member 18B of the lifting members 18A, 18B, i.e., a pair of air cylinders is operated so as to cause another hold-down contacting element 20 for the member 18B to hold down the wire-like object in the second layer, as shown. As can be seen from FIG. 9, there are provided a pair of contacting elements 20, 20 and a pair of lifting members 18*a*, 18*b*. The hold-down contacting members 20, 20 have 'L' shaped ends whose open sides are positioned in opposing relation to each other. Thus, in case the wire-like object is wound from the left to the right, the open side of the 'L' shaped end of the contacting member 20 on the side of the member 18*a* is directed towards the righthand flange 1*a*. On the other hand, in case a wire-like object is wound from the right to the left, the open side of the 'L' shaped end of the contacting element 20 on the side of the member 18*b* is directed to the lefthand flange 1*a*. In this manner, the holddown contacting elements 20, 20 are used alternately, depending on the varying directions of the wire-like object being wound.

When the hold-down contacting element 20 holds down the wire-like object 2 in the second layer, the winding of the wire-like object leftwards is ready.

Figure 12:
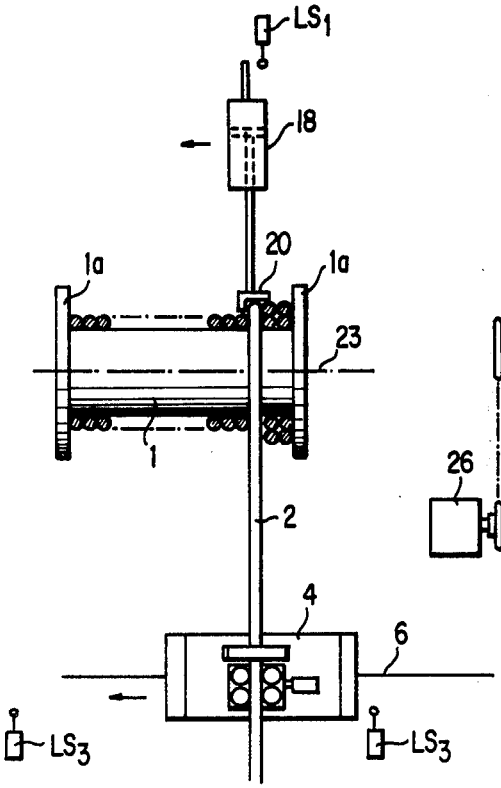

FIG. 12 shows the winding condition of a wire-like object in the second layer on the first layer of the wire-like object 2. As the traverser means 4 traverses to the left, the wire-like object 2 is wound around a drum portion of a bobbin to the left. In response thereto, the hold-down contacting element is moved to the left, and so moves the position detecting means 3. In this case, as in the preceding case, the means 3, 4 are moved in synchronism with each other by means of the potentiometers 8, 9. When the wire-like object 2 in the second layer approaches to the righthand flange 1*a* of the bobbin at a distance corresponding to the diameter of a wire-like object, then detecting members $LS_1$, and $LS_3$ positioned on the left side are actuated, so that traversing and winding of the wire-like object in the opposite direction will begin automatically. In this case, it is not to mention that the threaded shaft 5 which engages the position detecting means 3 is rotated in the normal and reverse directions by means of the torque motor 11 which varies the direction of its rotation, depending on the rightward and leftward winding of the wire-like object, thereby imparting a resistance or force to a wire-like object being wound, in the direction against the traversing direction.

As is apparent from the foregoing description of the winding machine according to the present invention, a wire-like object such as an electric wire may be automatically wound around a drum portion of a bobbin in closely packed layers, accurately.

More particularly, according to the present invention, there are separately provided position detecting means 3 for automatically detecting the position of a wire-like object which is about to be wound around a drum portion of a bobbin, and traverser means 4 for the wire-like object, while both means 3, 4 may operate in synchronism with each other, with the result that the winding of the wire-like object around a drum portion of a bobbin may be achieved extremely accurately over the entire width of the drum portion, with freedom from the danger of lap or irregular winding. In addition to this, the position detecting means 3 is provided with hold-down contacting elements which are adapted to hold down the wire-like object being wound and may be lifted a distance from the wire-like object, upon completion of the traversing of the traverser means in one direction according to the accurate detection of the detecting members, thus insuring automatic traversing movements of the traverser means, with the accompanying freedom from danger of the contacting elements being disengaged from the wire-like object inadvertently. In addition, the position detecting means is lifted a distance from the wire-like object, which distance is equal to the diameter of the wire-like object, due to the detecting members, such as limit switches or the like, when the position detecting means approach to a flange of the bobbin. As a result, the winding of the wire-like object for the next upper layer may be accomplished smoothly. Still furthermore, the provision of the RPM detecting member insures accurate control for a timing of the traverser means to reverse the traversing stroke, and enables the accuate automatic winding of a wire-like object.

While the present invention has been described herein with reference to certain exemplary embodiments thereof, it should be understood that various changes, modifications, and alterations may be effected without departing from the spirit and the scope of the present invention, as defined in the appended claims.

What is claimed as new as desired to be secured by Letters Patent of the United States is:

1. An automatic winding machine for winding a wire-like object such as an electric wire around a drum portion of a bobbin in multiple closely packed layers, which comprises:

a wire-like object position detecting means;

a first synchronizing mechanism attached to said detecting means;

at least one hold-down contacting element connected with said position detecting means which is positioned above said drum portion of said bobbin;

means for reciprocating said position detecting means in parallel with the axis of said bobbin on a first traverse shaft extending in parallel with the axis of said bobbin, wherein said contacting elements hold-down the wire-like object against a surface of said drum portion of said bobbin in the position of the wire-like object which is about to be wound around said drum portion;

traverser means reciprocably mounted on a second traverse shaft extending in parallel with the axis of said bobbin and connected with said first traverse shaft through which said wire-like object is fed and a second synchronizing mechanism connected with said traverser means for moving said traverser means in synchronism with said wire-like object position detecting means; wherein said first synchronizing mechanism allows for movement of said wire-like object position detecting means in synchronism with said traverser means; and lifting means connected to said wire-like object position detecting means and said traverser means for ascending and descending said wire-like object position detecting means and said traverser means in a vertical direction which is perpendicular to the axis of said bobbin.

2. An automatic winding machine as set forth in claim 1, wherein said machine further comprises a RPM detecting means for detecting the RPM of said bobbin connected to said first traverse shaft.

3. An automatic winding machine as set forth in claim 1, wherein each end of said contacting element is of a 'L' shape in cross section.

4. An automatic winding machine as set forth in claim 1, wherein each end of contacting elements is of a 'T' shape in cross section.

5. An automatic winding machine as set forth in claim 1, which further comprises a pair of hold-down members providing for leftward and rightward traversing strokes, respectively, commensurate with the reciprocating movements of said position detecting means.

6. An automatic winding machine as set forth in claim 1, wherein said machine further comprises detecting means for detecting the arrival of said hold-down member to a flange of said bobbin, thereby preventing an increased wind-up diameter portion of a coil at the flange end of said bobbin.

7. An automatic winding machine, as set forth in claim 6, wherein said detecting means comprises a plurality of limit switches.

8. An automatic winding machine as set forth in claim 6, wherein said detecting means comprises a plurality of photo-switches.

9. An automatic winding machine as set forth in claim 1, wherein said machine further comprises a pair of distance detecting members connected to said at least one hold-down contacting element for contacting the inner surface of opposite flanges of said bobbin for detecting the distance between the inner surfaces of said flanges such that accurate determination of distance of travel of said traversing means can be determined.

10. An automatic winding machine as set forth in claim 1, wherein said machine further comprises a resistance producing mechanism for applying a resistance or force to said wire-like object in the direction against the direction in which said wire-like object is being wound.

* * * * *